US008136702B2

(12) United States Patent
Skillern et al.

(10) Patent No.: US 8,136,702 B2
(45) Date of Patent: Mar. 20, 2012

(54) PRESSURIZED HYDRATION SYSTEM

(75) Inventors: Jeff Skillern, Boise, ID (US); James H. Sadler, Huntington, VT (US)

(73) Assignee: Oakley, Inc., Foothill Ranch, CA (US)

( * ) Notice: Subject to any disclaimer, the term of this patent is extended or adjusted under 35 U.S.C. 154(b) by 384 days.

(21) Appl. No.: 11/764,620

(22) Filed: Jun. 18, 2007

(65) Prior Publication Data

US 2008/0308578 A1 Dec. 18, 2008

Related U.S. Application Data

(60) Provisional application No. 60/822,273, filed on Aug. 14, 2006.

(51) Int. Cl.
*B65D 37/00* (2006.01)
*B67D 7/60* (2010.01)

(52) U.S. Cl. ..... 222/209; 222/95; 222/105; 222/386.5; 222/389; 222/399; 224/148.2; 220/703; 62/457.9

(58) Field of Classification Search ..... 222/94, 222/95, 105, 175, 146.6, 209, 386.5, 389, 222/399, 400.5, 400.7, 400.8; 224/148.2; 220/703; 62/457.9
See application file for complete search history.

(56) References Cited

U.S. PATENT DOCUMENTS 3,309,890 A * 3/1967 Barnett et al. ..... 62/294
3,677,443 A * 7/1972 Smadar et al. ..... 222/94
4,420,097 A * 12/1983 Motsenbocker ..... 222/131
4,629,098 A 12/1986 Eger
4,998,415 A * 3/1991 Larsen ..... 62/231
5,062,591 A 11/1991 Runkel
5,282,557 A * 2/1994 McCook ..... 224/148.2
5,447,039 A * 9/1995 Allison ..... 62/293
5,913,456 A * 6/1999 Dikeman ..... 222/95
5,940,880 A * 8/1999 Phillips ..... 2/7
6,581,538 B2 6/2003 Sorensen
2002/0166493 A1 11/2002 Sorensen
2006/0144862 A1 7/2006 Reichert et al.
2006/0144863 A1 7/2006 Reichert et al.
2007/0164037 A1 7/2007 Chen (Continued)

OTHER PUBLICATIONS

U.S. Appl. No. 60/987,741 and cover sheet, filed on Nov. 13, 2007 by Reichert et al., entitled "Pressurized Fluid Delivery System With Filter and Associated Method," in 24 pages.

(Continued)

*Primary Examiner* — Kevin P Shaver
*Assistant Examiner* — Melvin Cartagena
(74) *Attorney, Agent, or Firm* — Knobbe Martens Olsen & Bear, LLP.

(57) ABSTRACT

A hydration system includes opposing flexible walls forming a bladder having a sealable compartment for containing a liquid. The system includes a drinking tube having a first end with a valve and a second end. A first port is configured to receive pressurizing gasses into the compartment. A baffle connects the opposing walls within the compartment. The baffle is configured to oppose expansion of the bladder as the pressurizing gasses are introduced into the compartment. A second port is configured to couple to the second end of the drinking tube to provide fluid communication between the compartment and the drinking tube. A third port allows the liquid to be supplied into the compartment. Activation of the valve unseals the compartment and allows the liquid to be expelled from the compartment via the second port and the drinking tube as a result of a pressurization of the compartment by the pressurizing gasses.

18 Claims, 14 Drawing Sheets

U.S. PATENT DOCUMENTS

| | | | |
|---|---|---|---|
| 2008/0029561 | A1 | 2/2008 | Reichert et al. |
| 2008/0308032 | A1 | 12/2008 | Skillern |
| 2009/0140005 | A1 | 6/2009 | Reichert et al. |
| 2009/0179046 | A1 | 7/2009 | Reichert et al. |
| 2009/0302261 | A1 | 12/2009 | Skillern |
| 2010/0044396 | A1 | 2/2010 | Skillern |

OTHER PUBLICATIONS

U.S. Appl. No. 12/191,254, filed Aug. 13, 2008, published as 2008-0308032 on Dec. 18, 2008, including its ongoing prosecution history, including office communications dated Dec. 29, 2009 and Jul. 1, 2010.

U.S. Appl. No. 12/322,995, filed Feb. 9, 2009, published as 2009-0302261 on Dec. 10, 2009, including its ongoing prosecution history.

U.S. Appl. No. 12/204,326, filed Sep. 4, 2008, published as 2010-0044396 on Feb. 25, 2010, including its onging prosecution history.

International Search Report of Oct. 1, 2009 in International Application No. PCT/US2009/053784 filed on Aug. 13, 2009 from the International Searching Authority 8 pages.

* cited by examiner

PRESSURIZED HYDRATION SYSTEM

CLAIM FOR PRIORITY

This application claims the benefit of priority of U.S. Provisional Patent Application No. 60/822,273, filed on Aug. 14, 2006, and having the same title.

BACKGROUND

Personal hydrations systems help athletes maintain adequate hydration while engaging in strenuous physical activities, such as running, cycling, skiing, hiking, or mountain climbing. These personal hydration systems typically include a bag-like reservoir carried in a back pack or waist pack. A flexible drinking tube connects to the reservoir through an exit port at one end and terminates in a mouthpiece at the other end. The tube is long enough to allow the mouthpiece to be carried in the user's mouth to enable the user to draw water from the reservoir like sucking water through a straw. When low on breath during vigorous exercise, drawing water from the reservoir can prove to be a difficult task.

DESCRIPTION OF THE DRAWINGS

FIG. 1. is a top plan view, while FIG. 2 is a side elevation view.

FIG. 3 is a top plan view. FIGS. 4 and 5 are partial exploded views. FIGS. 6 and 6A are partial cross sectional views. FIG. 7 illustrates a reservoir being filled with a liquid.

DETAILED DESCRIPTION

Introduction: Various embodiments of the present invention assist in expelling liquid from a personal hydration system. The following description is broken into sections. The first provides an example of a conventional hydration system. The second section provides an example of a pressurized hydration system. The third section describes a remote pressurized hydration system. The fourth section describes various balloon pressurized hydration systems. The fifth section discusses manual pressurization, and the last section describes a self-cooling pressurized hydration system.

In the various examples discussed below, the term reservoir is used. While the figures show specific examples of bag like reservoirs, other types of containers such as sports bottles and the like are encompassed by the term reservoir. In short, the term reservoir refers to any object in which a drinking fluid can be sealed.

Figure 1:
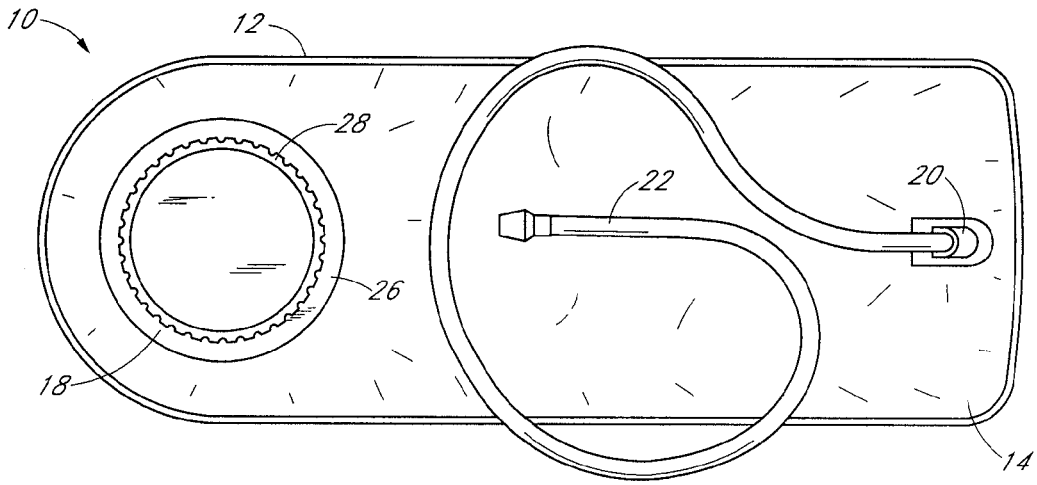
FIG. 1 (PRIOR ART)
FIGS. 1 and 2 illustrates an exemplary a personal hydration system in the form of a reservoir.
Figure 2:
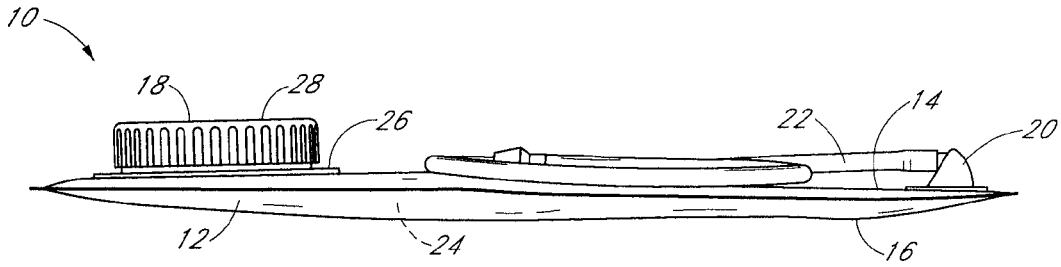
FIG. 2 (PRIOR ART)
Figure 3:
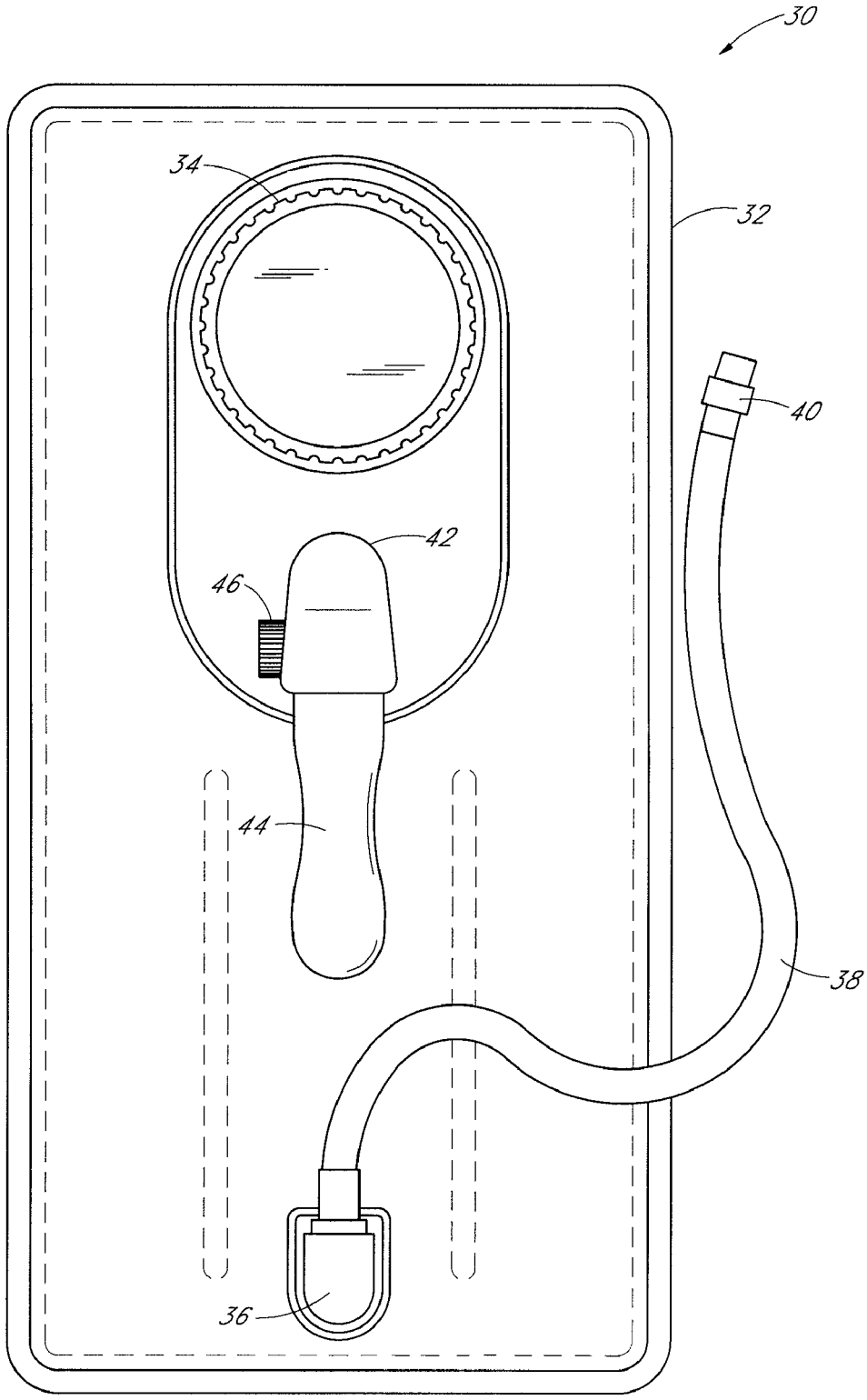
FIGS. 3-7 illustrate a pressurized hydration system.

Non-Pressurized Hydration System: FIGS. 1 and 2 illustrate an exemplary hydration system in the form of reservoir 10. Reservoir 10 includes bladder 12 formed by opposing walls 14 and 16 (seen best in FIG. 2), fill port 18, exit port 20, and drinking tube 22. Walls 14 and 16 form an internal compartment 24 adapted to store a volume of fluid such as water. Walls 14 and 16 can be formed from a flexible, waterproof material. An example of a suitable material is polyurethane, although others may be used. The size and shape of compartment 24 may vary, such as depending upon the desired application with which the system will be used, any pack into which reservoir 10 will be placed, the mechanism by which the reservoir 10 will be transported, and the volume of drink fluid that compartment 24 is designed to hold.

The length of drinking tube 22 may vary depending upon the desired distance between the user's mouth and the location where reservoir 10 is positioned, such as on a user's back, waist, inside a user's garments, on a user's bike or other equipment. An end of drinking tube 22 is connected to reservoir 10 at exit port 20 through which fluid in compartment 24 is received into tube 22. In other words, compartment 24 is in fluid communication with exit port 20.

Reservoir 10 includes fill port 18 through which fluid may be poured into or removed from compartment 24. Fill port 18 also provides an opening through which compartment 24 may be accessed for cleaning. As shown, fill port 18 includes collar 26 and cap 28. Collar 26 is sealed to wall 14. Cap 28 is removeably sealed to collar 26. For example, collar 26 and cap 28 may include mating threads and a gasket allowing cap 28 to be twisted off to be separated from collar 26 and twisted on to be sealed to collar 26. With cap 28 removed, a fluid can be poured into compartment 24 through collar 26 of fill port 18. Cap 28 can then be sealed to collar 26 securing the fluid in compartment 24. User supplied suction applied to drinking tube 22 can then pull the fluid out of compartment 24 through exit port 20.

Pressurized Hydration System: FIGS. 3-7 illustrate an exemplary pressurized hydration system in the form of reservoir 30. In this example, reservoir 30 includes bladder 32 formed by opposing walls 50 and 52 (seen best in FIG. 6), fill port 34, exit port 36, drinking tube 38, and bite valve 40. Walls 50 and 52 form an internal sealable compartment 54 (seen best in FIG. 6) adapted to store a volume of fluid such as water. Walls 50 and 52 can be formed from a flexible, waterproof material. An example of a suitable material is polyurethane, although others may be used. The size and shape of compartment 54 may vary, such as depending upon the desired application with which the system will be used, any pack into which reservoir 30 will be placed, the mechanism by which the reservoir 30 will be transported, and the volume of drink fluid that compartment 54 is designed to hold.

The length of drinking tube 38 may vary depending upon the desired distance between the user's mouth and the location where reservoir 30 is positioned, such as on a user's back, waist, inside a user's garments, on a user's bike or other equipment. An end of drinking tube 38 is connected to reservoir 30 at exit port 36 through which fluid in compartment 54 is received into tube 38. In other words, compartment 54 is in fluid communication with exit port 36.

Reservoir 30 includes fill port 34 through which fluid may be poured into or removed from compartment 54. Reservoir 30 includes pressure port 42 and pressure regulator 46. Pressure port 42 represents an inlet through which a pressurizing gas can enter into compartment 54. Pressurizing gasses can be provided via a pressurizer such as cartridge holder 44 and cartridge 48 (best seen in FIGS. 5 and 6). Cartridge holder 44 is configured to hold and cause cartridge 48 to mate with pressure port 42 in such a manner that pressurizing gas is allowed to expel from cartridge 48 and enter compartment 54. Pressure regulator 46 functions to regulate the level at which internal compartment is pressurized. Pressure regulator 46 may also function as a manual on/off switch and may regulate a rate at which pressurizing gas is allowed to escape cartridge 48 and enter compartment 54.

Once compartment 54 is filled with a liquid and pressurized, activation of bite valve results in the liquid being forced out of compartment 54 through drinking tube 38 and into a person's mouth. In this manner the person utilizing the reservoir 30 need only bite on bite valve 40 and liquid is expelled. The person need not suck to draw liquid from compartment 54.

Figure 4:
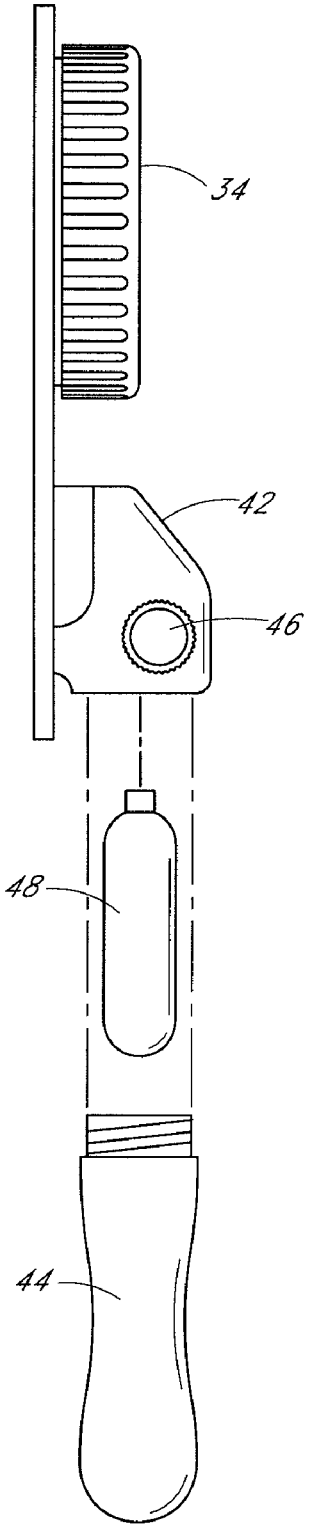
Figure 5:
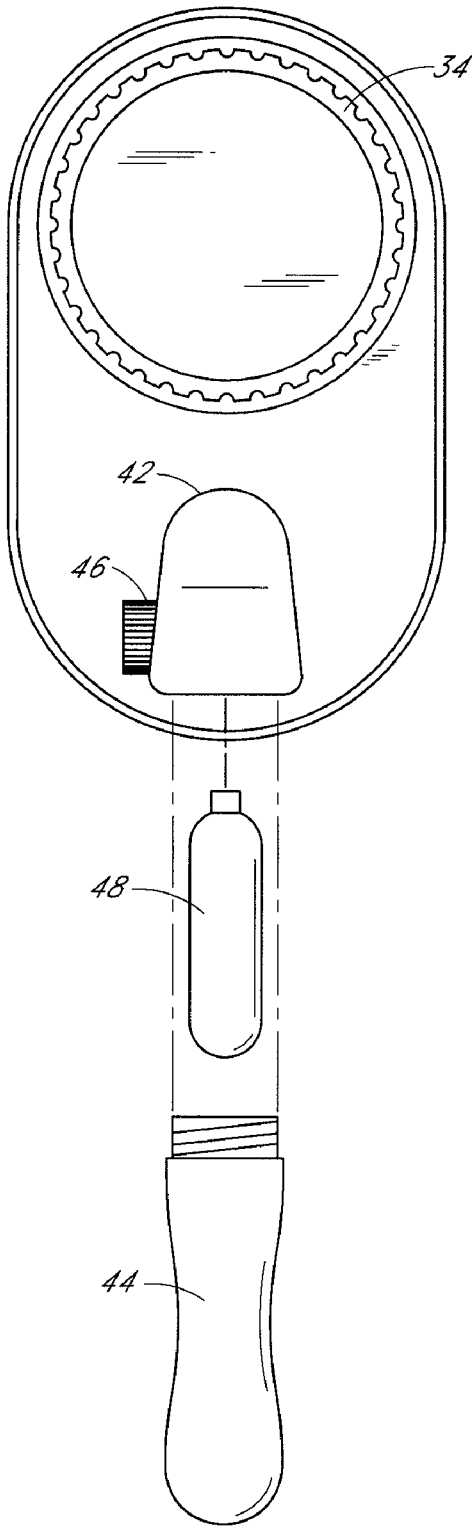

Focusing on FIGS. 4 and 5, cartridge 48 is shown to fit inside cartridge holder 44. Cartridge holder 44 threads into pressure port 42 causing cartridge 48 to engage pressure port 52 allowing pressurizing gas to be expelled from cartridge 48 through pressure port 42 and into compartment 54.

It is noted that fill port 34, exit port 36, and pressure port 42 are shown as being formed in wall 50 such that fill port 34 provides ingress for liquid into compartment 54. Likewise, pressure port 42 provides ingress for pressurizing gasses into compartment 54, and exit port 36 provides an egress for liquid out of compartment 54. While show as being formed in wall 50, one or more of ports 34, 36, and 42 may be formed in wall 52 or elsewhere so long as they provide the noted ingress and egress functions. Furthermore, two or more of ports 34, 36, and 42 may be the same port.

Figure 6:
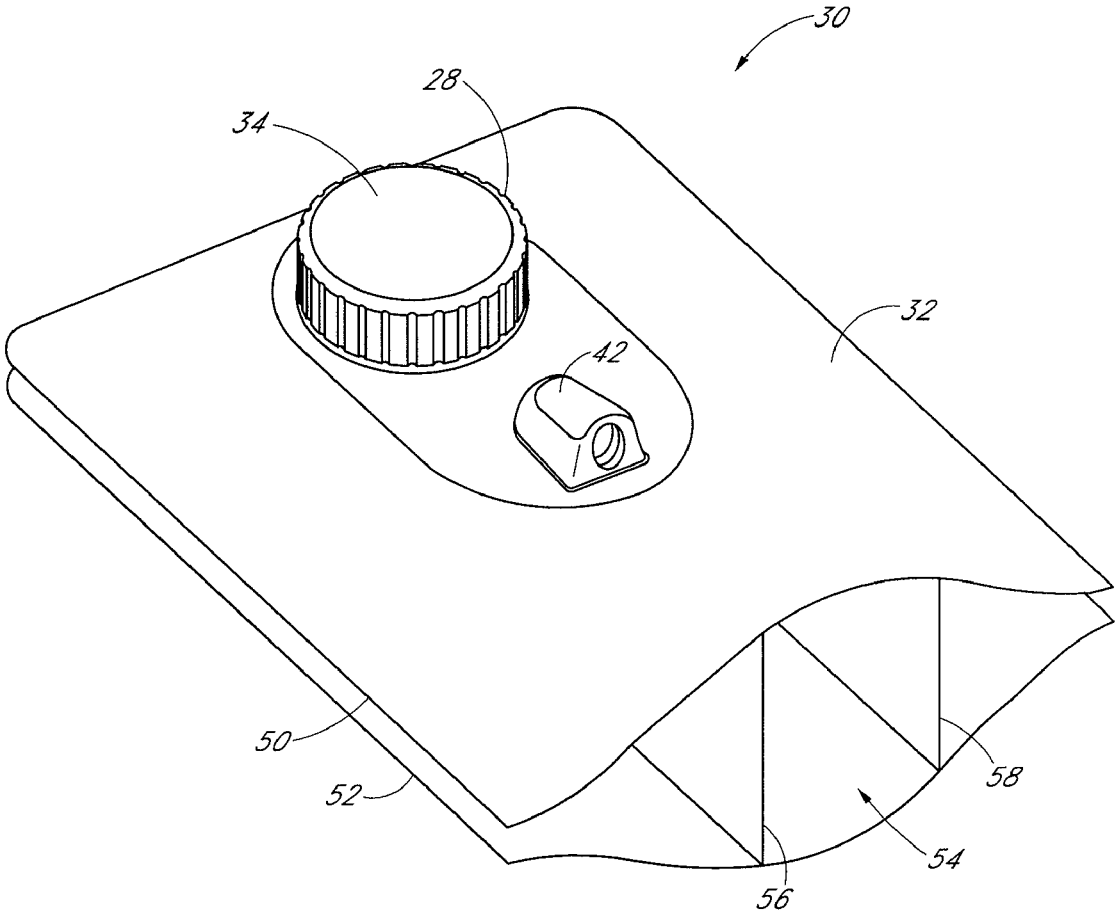
Figure 6A:
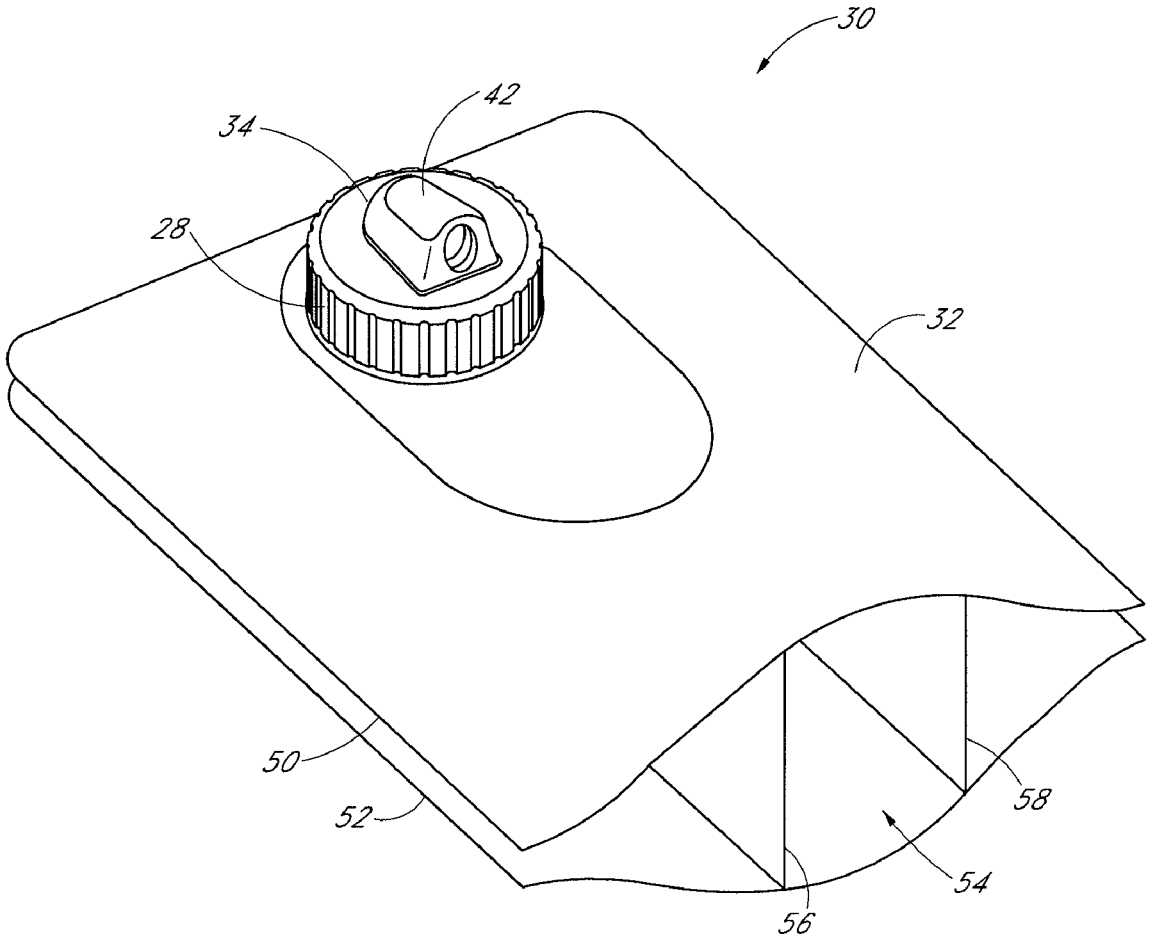
Figure 7:
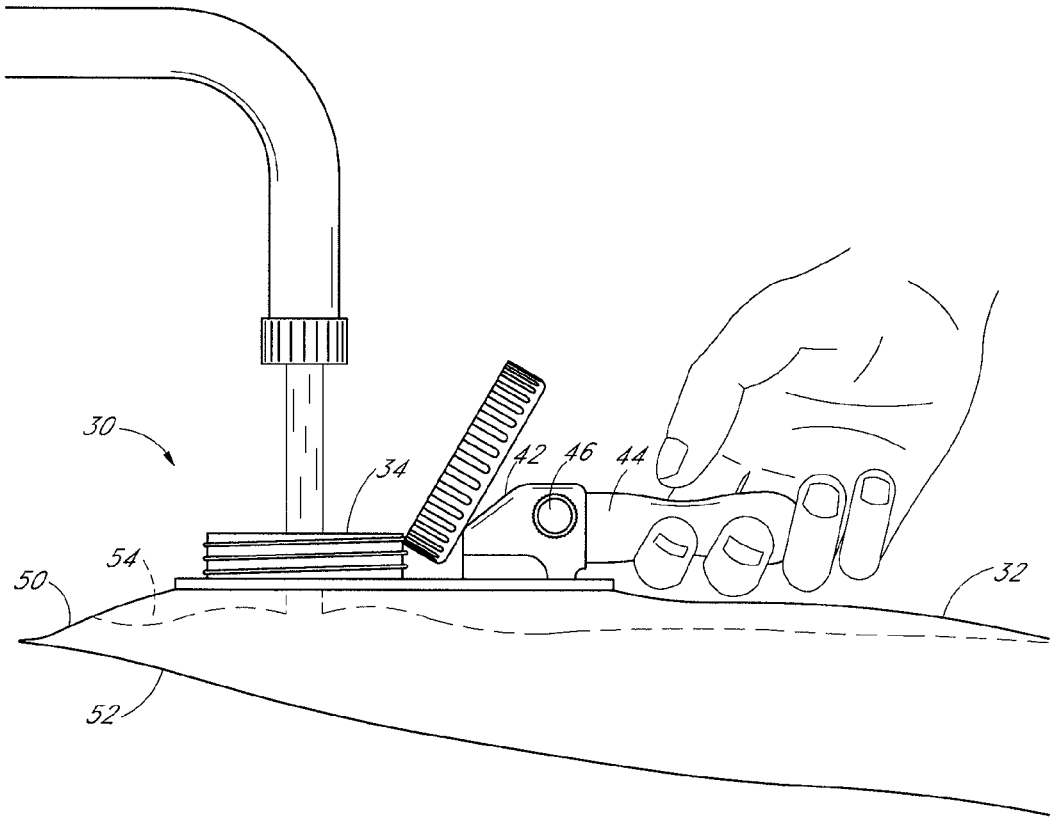

Moving to FIG. 6, reservoir 30 is shown to include baffles 56 and 58 that connect wall 50 to wall 52 within compartment 54. As compartment 54 is pressurized, it tends to expand separating walls 50 and 52. Baffles 56 and 58 operate to oppose expansion or "footballing" of walls 50 and 52 as pressurizing gasses are introduced into compartment 54. FIG. 6A shows an embodiment wherein the fill port 34 includes cap 28 configured to close fill port 34. In this embodiment, the pressure port 42 is formed in cap 28 and is configured to provide an ingress for the pressurizing gasses through cap 28 into the compartment 54 when cap 28 is closing the fill port 34. In FIG. 7, it is shown that cartridge holder 44 can also function as a handle when filling reservoir 30.

Figure 8:
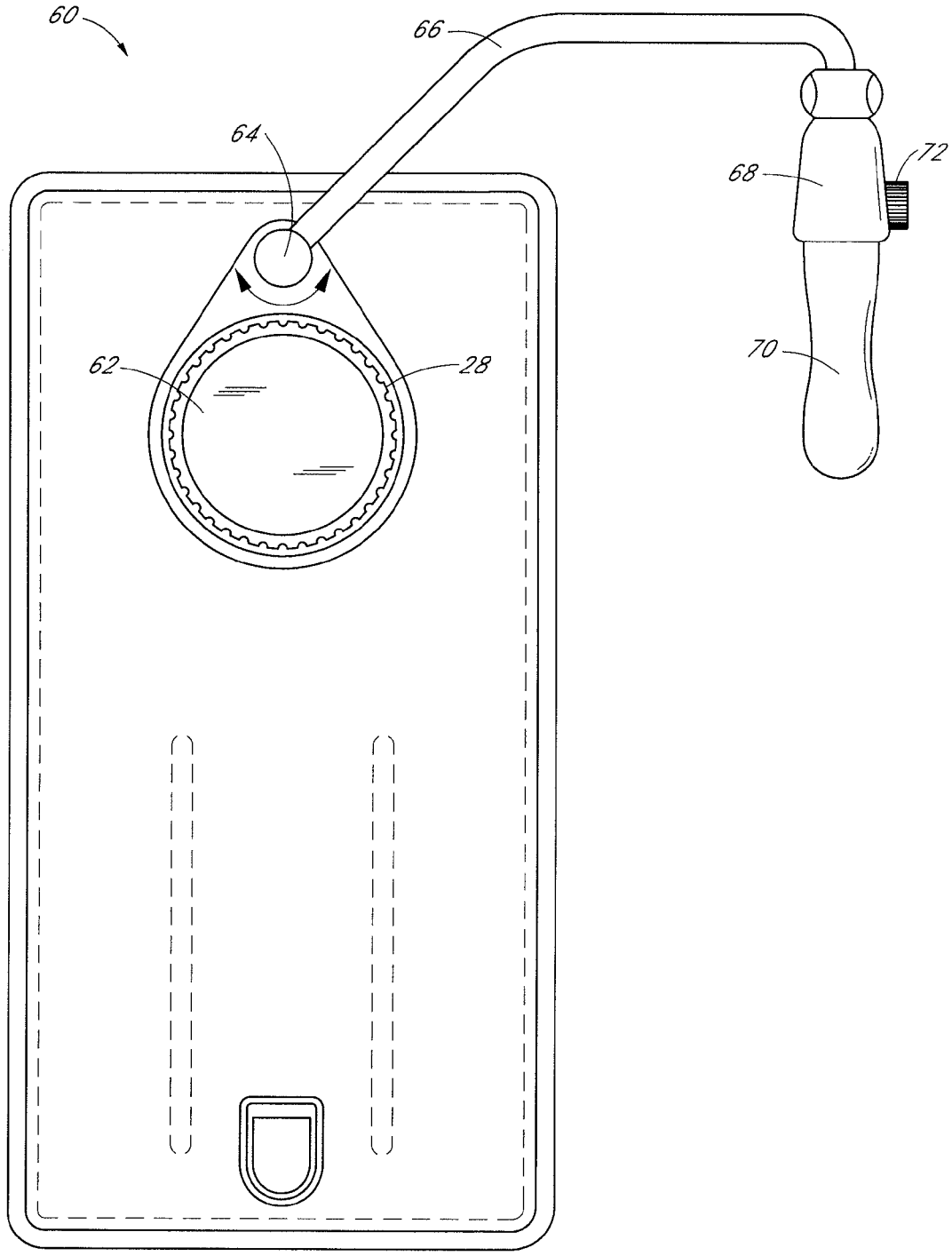
FIG. 8 and FIG. 8A illustrate remote pressurized hydration systems.
Figure 8A:
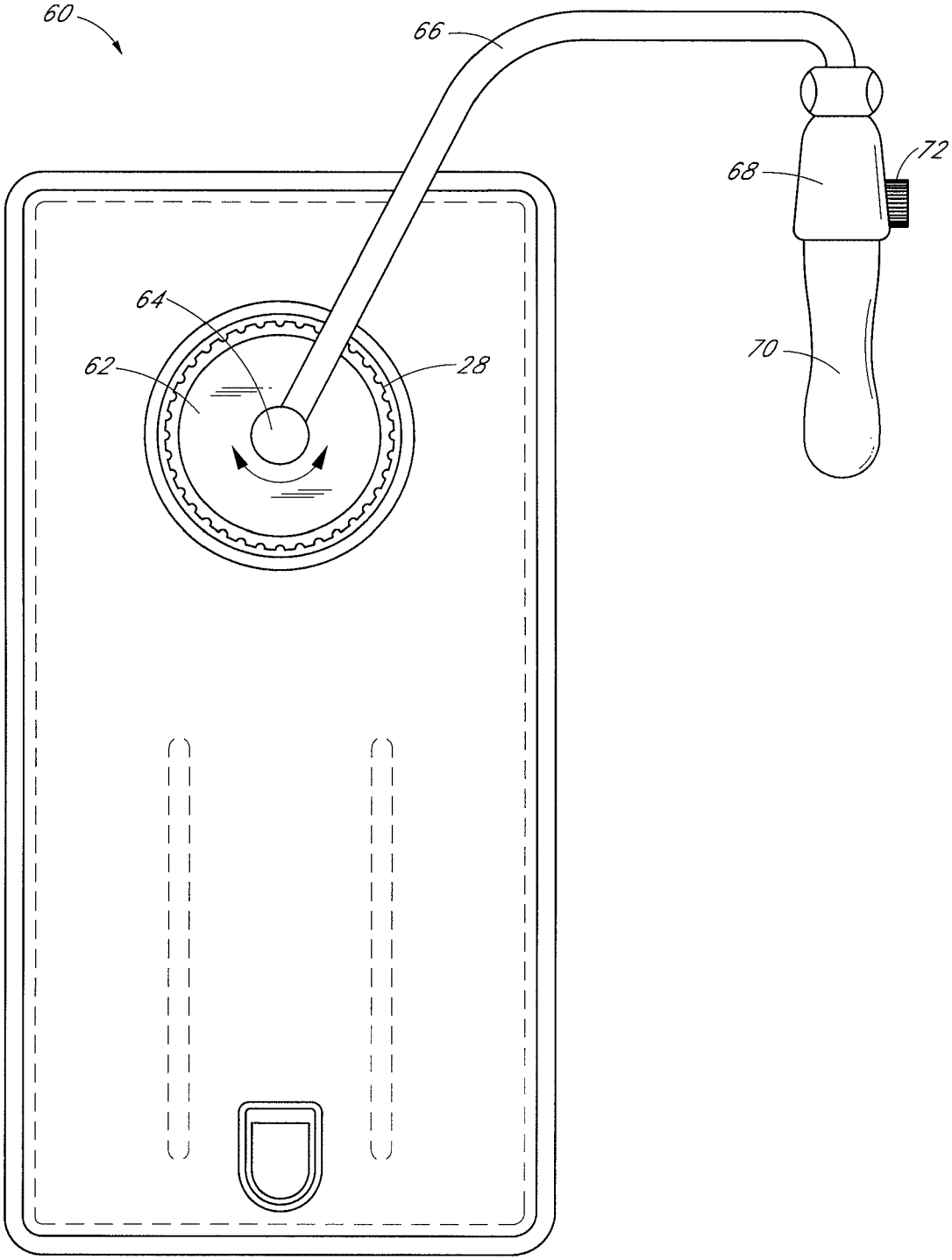

Remote Pressurized Hydration System: FIG. 8 illustrates an exemplary remote pressurized hydration system in the form of reservoir 60. Reservoir 60 includes fill port 62, swivel port 64, transfer tube 66, pressure port 68, cartridge holder 70, and pressure regulator 72. Swivel port 64 serves to provide an input for pressurizing gas into reservoir 60 via transfer tube 66. As its name suggests swivel port 64 swivels allowing transfer tube 66 to rotate about a point. Swivel port 64 may be integrated into fill port 62, such as the embodiment shown in FIG. 8A. For example, fill port 62 is shown to include a cap 28 that closes fill port 62. Swivel port 64 could be formed in that cap 28 such that when fill port 62 is closed, swivel port 64 would provide input for pressurizing gases through the cap 28 and into reservoir 60.

Transfer tube 66 couples pressure port 68 to swivel port 64 and serves as a sealed transfer allowing pressurizing gas to pass from pressure port 68 through swivel port 64, and into reservoir 60. Pressure port 68 represents an inlet through which a pressurizing gas can ultimately be introduced into reservoir 60. Pressurizing gasses can be provided via a cartridge such as cartridge 48 seen in FIGS. 5 and 6. Cartridge holder 70 is configured to hold a cartridge allowing it to mate with pressure port 68 in such a manner that pressurizing gas is allowed to exit the cartridge and enter reservoir 60 via transfer tube 66 and swivel port 64. Pressure regulator 72 functions to regulate the level at which reservoir 60 is pressurized. Pressure regulator 72 may also function as a manual on/off switch and may regulate a rate at which pressurizing gas is allowed to escape a cartridge.

A length of transfer tube 66 is selected to allow for convenient access to pressure port 68 and regulator 72. For example pressure port 68 may be attached to or integrated within a shoulder strap of a backpack used to carry reservoir 60. In this manner, a person can more easily access pressure port 68 and regulator 72 while wearing that backpack.

Balloon Pressurized Hydration System: In the Examples of FIGS. 3-7, reservoir 30 included an internal compartment 54 for containing a liquid. The reservoir 30 is pressurized by introducing pressurizing gas into compartment 54 along with the liquid. FIGS. 9-12 illustrate another embodiment in which pressurizing gas is introduced into a balloon fitted within a reservoir. Expansion of that balloon pressurizes the reservoir.

Figure 9:
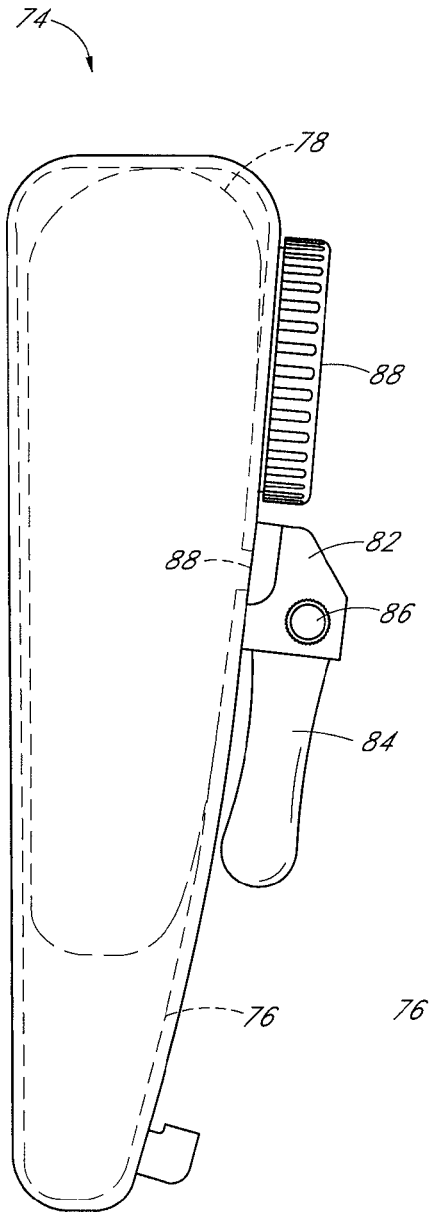
FIGS. 9-12 illustrate balloon pressurized hydration systems.
Figure 10:
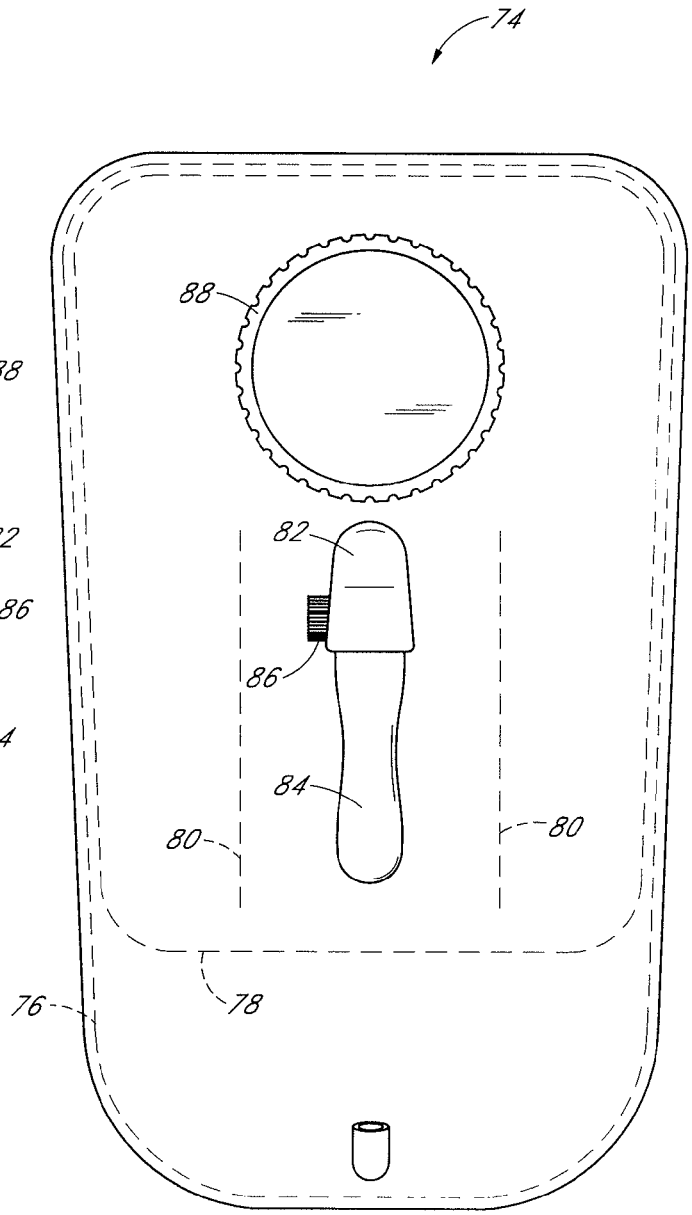

Starting with FIGS. 9 and 10, reservoir 74 includes bladder 76 defining an internal compartment for containing a liquid. Balloon 78 is fitted within that internal compartment with the liquid. Reservoir 74 includes support members 80 designed to help prevent reservoir 78 from "footballing" or over expanding as balloon 78 is pressurized. Reservoir 74 also includes pressure port 82 and pressure regulator 86. Pressure port 82 represents an inlet through which a pressurizing gas can enter into balloon 78 through passage 88. Pressurizing gasses can be provided via a cartridge such as cartridge 48 seen in FIGS. 5 and 6. A cartridge holder 84 is configured to hold and cause the cartridge to mate with pressure port 82 in such a manner that pressurizing gas is allowed to exit the cartridge 48 and enter balloon 78. Pressure regulator 86 functions to regulate the level at which balloon 78 is pressurized. Pressure regulator 86 may also function as a manual on/off switch and may regulate a rate at which pressurizing gas is allowed to escape a cartridge and enter balloon 78. Introduction of pressurizing gas causes balloon 78 to expand pressurizing bladder 76.

Figure 11:
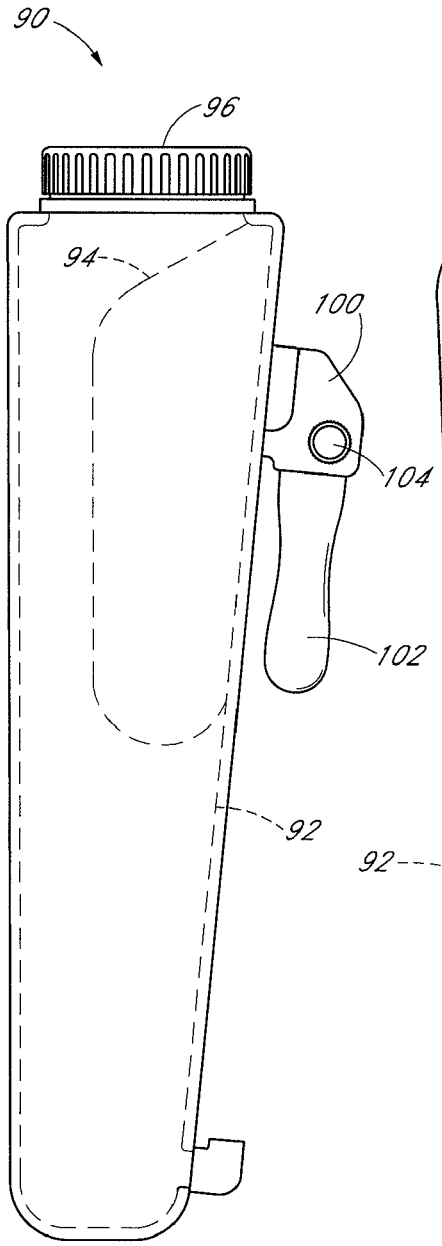
Figure 12:
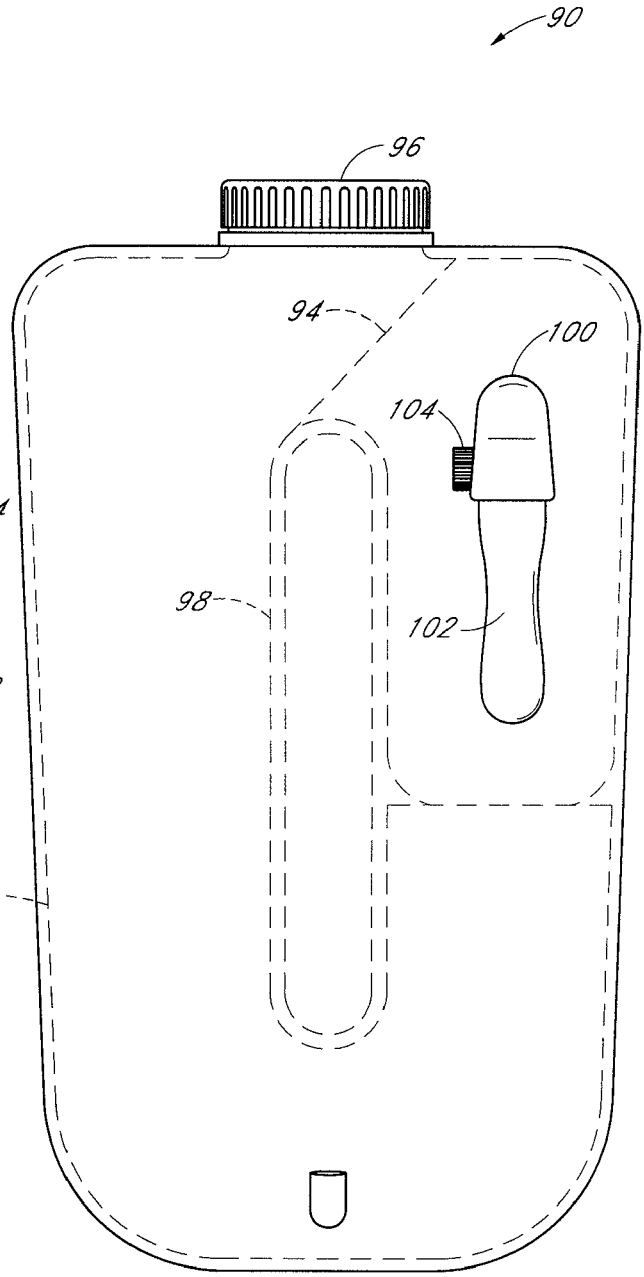

Moving to FIGS. 11 and 12, reservoir 90 includes bladder 92 into which balloon 94 is fitted. Reservoir 90 includes a top located entry port 96 through which liquid can be introduced into an internal compartment of bladder 92. Reservoir 90 includes central support member 98 designed to help prevent reservoir 90 from "footballing" or over expanding as balloon 94 is pressurized. Reservoir 90 also includes pressure port 100 and pressure regulator 104. Pressure port 100 represents an inlet through which a pressurizing gas can enter into balloon 94. Pressurizing gasses can be provided via a cartridge such as cartridge 48 seen in FIGS. 5 and 6. A cartridge holder 102 is configured to hold and cause the cartridge to mate with pressure port 100 in such a manner that pressurizing gas is allowed to exit the cartridge and enter balloon 94. Pressure regulator 104 functions to regulate the level at which balloon 94 is pressurized. Pressure regulator 104 may also function as a manual on/off switch and may regulate a rate at which pressurizing gas is allowed to escape a cartridge and enter balloon 94. Introduction of pressurizing gas causes balloon 94 to expand pressurizing bladder 92.

Figure 13:
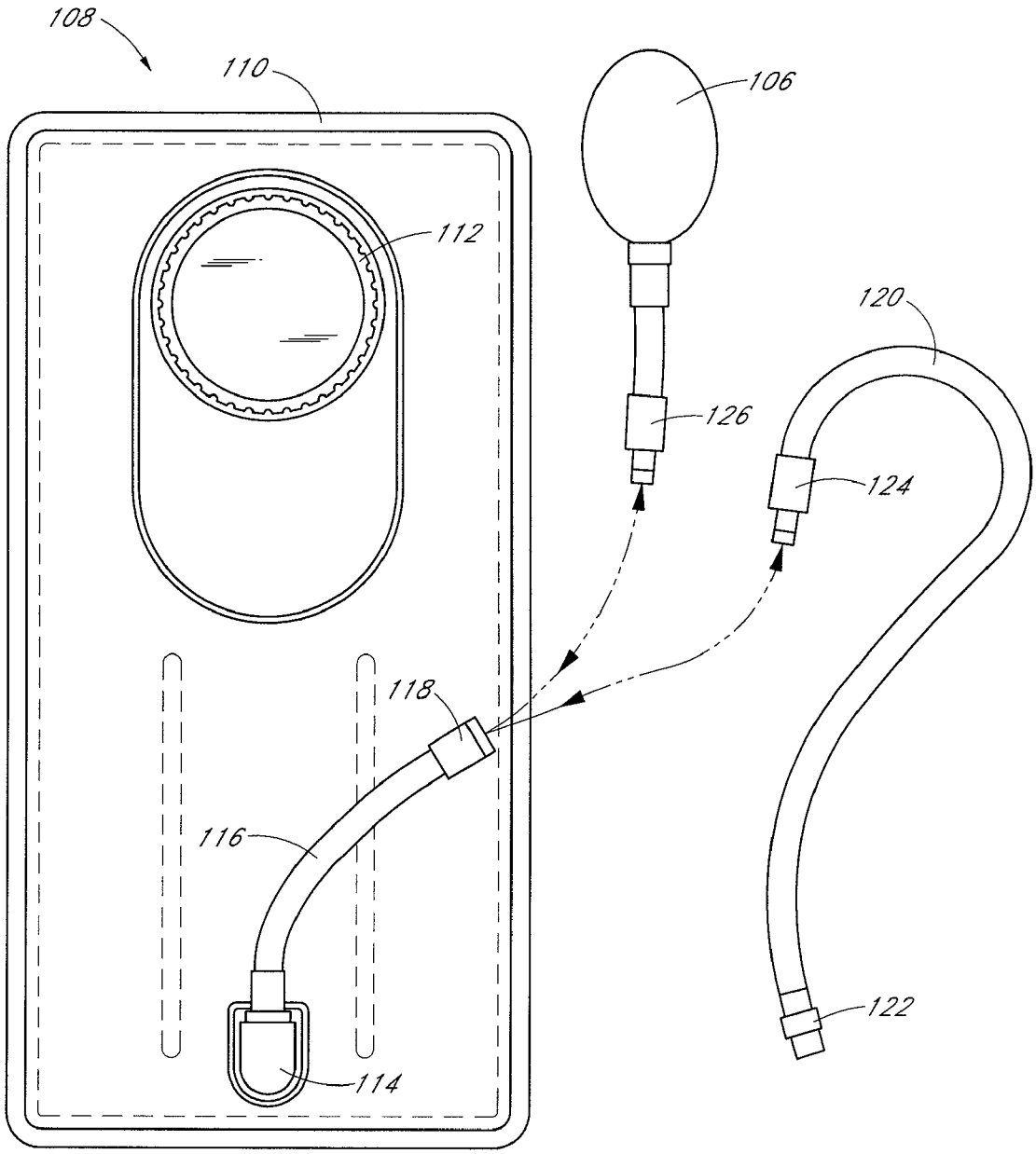
FIGS. 13-14 illustrate manually pressurized hydration systems.
Figure 14:
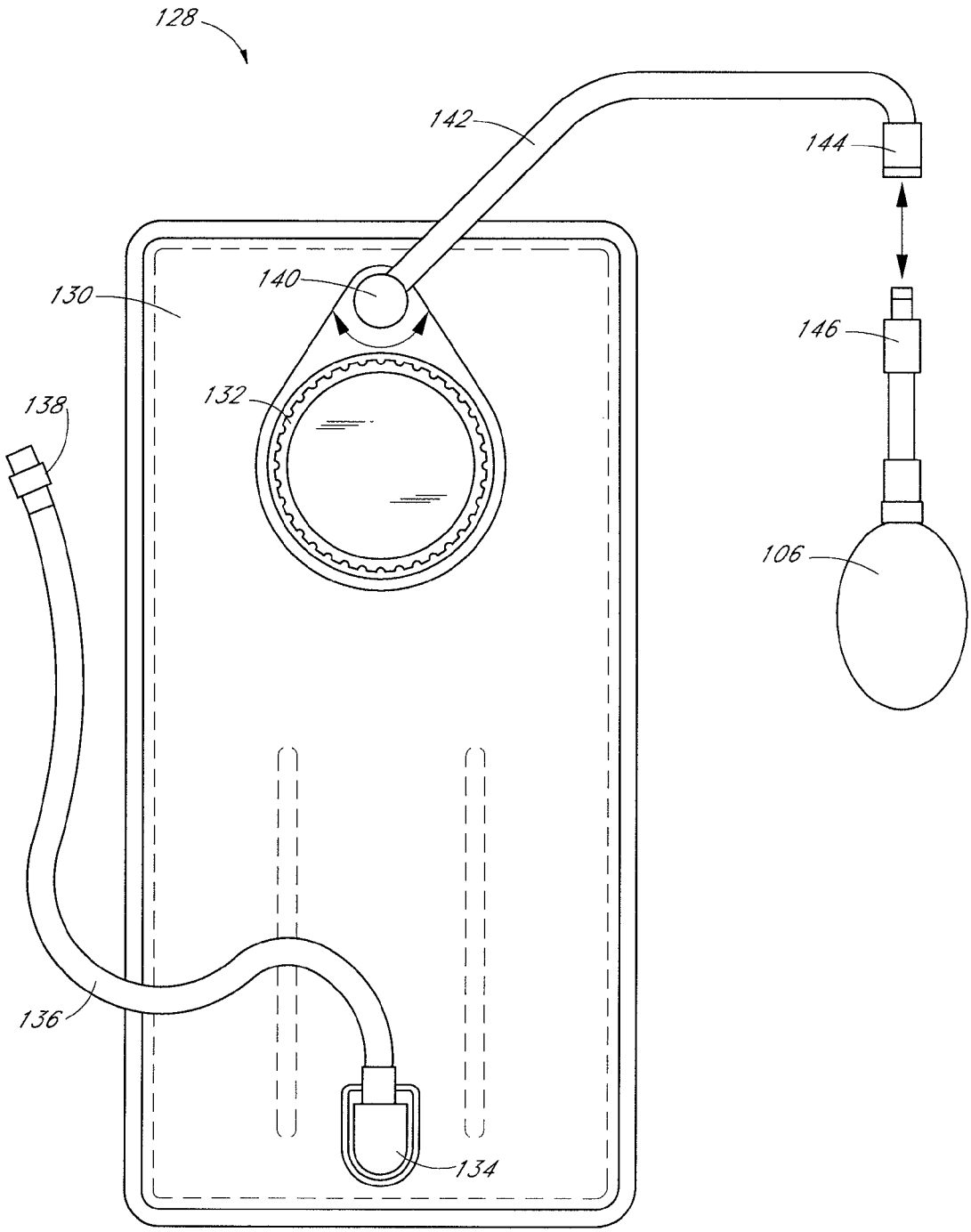

MANUAL PRESSURIZATION: While FIGS. 3-12 illustrate a pressurizer in the form of holder and cartridge such as holder 44 and cartridge 48. Other means for pressurizing are also contemplated. In FIGS. 13 and 14, for example, a pressurizer includes a bulb style pump such as squeeze pump 106.

Referring first to FIG. 13, reservoir 108 includes bladder 110, fill port 112, exit port 114, exit tube 116. One end of exit tube 116 is coupled to exit port 114. The other end of exit tube 116 is shown to include female coupler 118. Also shown are drinking tube 120 and squeeze pump 106. One end of drinking tube 120 includes bite valve 122 while the other end includes male coupler 124. Squeeze pump 106 include male coupler 126. Male couplers 124 and 126 are configured to be removably coupled to female coupler 118. Female coupler 118 includes a check valve (not shown) that is opened when coupled to either one of male couplers 124 or 126 allowing passage of fluids and gasses through female coupler 118.

When decoupled, the check valve is closed blocking the passage fluids and gasses through female coupler 118.

Male coupler 126 of squeeze pump 106 can be coupled to and decoupled from female coupler 118 of exit tube 116. When coupled, the repeated manual squeezing of squeeze pump 106 forces pressurizing gas in the form of air into bladder 110 via exit tube 116. Also, male coupler 124 of drinking tube 120 can be coupled to and decoupled from female coupler 118 of exit tube 116. When coupled, fluid contained in bladder 110 is allowed to pass into and through drinking tube 120. In this example, port 114 serves as an exit port through which fluid can exit bladder 110 and as a pressure port through which pressurizing gasses can enter bladder 110.

Once bladder 110 is filled with a liquid and pressurized using squeeze pump 106 and male coupler of drinking tube 124 is coupled to female coupler 118, activation of bite valve 122 results in the liquid being forced out of bladder 110 through exit tube drinking tube 38 and into a person's mouth. In this manner the person utilizing the reservoir 30 need only bite on bite valve 40 and liquid is expelled. The person need not suck to draw liquid from compartment 54.

Referring now to FIG. 14, reservoir 128 includes bladder 130, fill port 132, exit port 134, drinking tube 136, bite valve 138, swivel port 140, transfer tube 142, and female coupler 144. Also shown is squeeze pump 106 which includes male coupler 146 configured to couple to and decoupled from female coupler 144 of transfer tube 142. Female coupler 144 includes a check valve (not shown) that is opened when coupled to male coupler 146 allowing squeezed pump 106 to force pressurizing gasses through transfer tube 140 and into bladder 130. When decoupled, the check valve is closed blocking the passage of fluids and gasses through female coupler 144.

Swivel port 140 serves to provide an input for pressurizing gas into reservoir 128 via transfer tube 142. As its name suggests swivel port 140 swivels allowing transfer tube 142 to rotate about a point. With male coupler 146 of squeeze pump 106 coupled to female coupler 144 of transfer tube 142, the repeated manual squeezing of squeeze pump 106 forces pressurizing gasses in the form of air through transfer tube 142 into bladder 130. While not shown, swivel port 140 may be integrated into fill port 132. For example, fill port 132 is shown to include a cap that closes fill port 132. Swivel port 140 could be formed in that cap such that when fill port1322 is closed, swivel port 140 would provide input for pressurizing gases through the cap and into bladder 130.

A length of transfer tube 142 is selected to allow for convenient access to squeeze pump 106. For example squeeze pump 106 may be attached to or integrated within a shoulder strap of a backpack used to carry reservoir 128. In this manner, a person can more easily squeeze pump 106 while wearing that backpack.

Once bladder 110 is filled with a liquid and pressurized using squeeze pump 106, activation of bite valve 138 results in the liquid being forced out of bladder 130 through drinking tube 136 and into a person's mouth. In this manner the person utilizing the reservoir 128 need only bite on bite valve 138 and liquid is expelled. The person need not suck to draw liquid from bladder 130.

Figure 15:
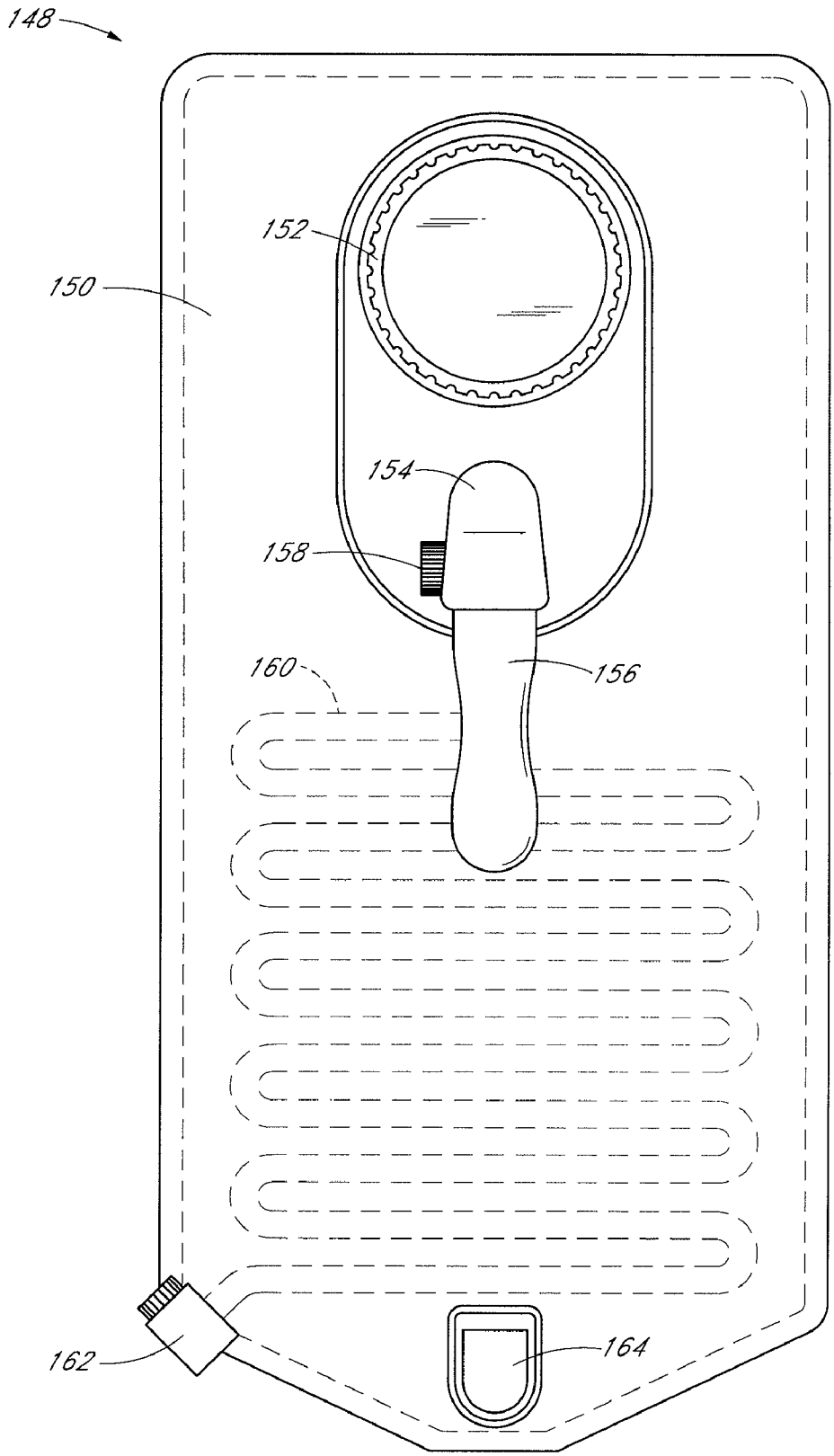
FIGS. 15-16 illustrate self-cooling pressurized hydration systems.

Self Cooling Pressurized Hydration System: FIG. 15 illustrates a reservoir 148 configured for use of a pressurized gas to cool its contents. As illustrated, reservoir 148 includes bladder 150, fill port 148, pressure port 154, cartridge holder 156, transfer coil 160, and gas exit port 162.

Bladder 150 defines an internal compartment for containing a liquid. Fill port 152 provides a sealable opening through which liquid can be introduced into bladder 150. Pressure port 154 represents an inlet through which a pressurizing gas can enter into transfer coil 160. Pressurizing gasses can be provided via a cartridge such as cartridge 48 seen in FIGS. 5 and 6. A cartridge holder 156 is configured to hold and cause the cartridge to mate with pressure port 154 in such a manner that pressurizing gas is allowed to exit the cartridge and enter transfer coil 160. Pressure regulator 158 functions to as a manual on/off switch and may regulate a rate at which pressurizing gas is allowed to escape a cartridge. Introduction of gas from a pressurized cartridge provides a cooling effect on the contents of bladder 150. Gas exit port 162 provides a means of escape for the gas. The winding path of transfer coil 160 provides additional surface area allowing the escaping case to more effectively cool the contents of bladder 150.

Reservoir 148 may be made of a series of adjacent layers of material. A first pair adjacent layers of reservoir 148 form a first internal compartment for holding a liquid. A second pair of adjacent layers form a second internal compartment for holding a cooling gel or other material that can be chilled or frozen to keep the liquid in the first compartment cool. It is noted that the first and second pair of layers may share a common layer such that reservoir 148 is made of three adjacent layers with the center layer being common to each pair of adjacent layers. Transfer coil 164 may be formed between the second pair of layers containing the cooling gel. In this manner, gas escaping a pressurized cartridge and passing through transfer coil 160 can chill the cooling gel.

Figure 16:
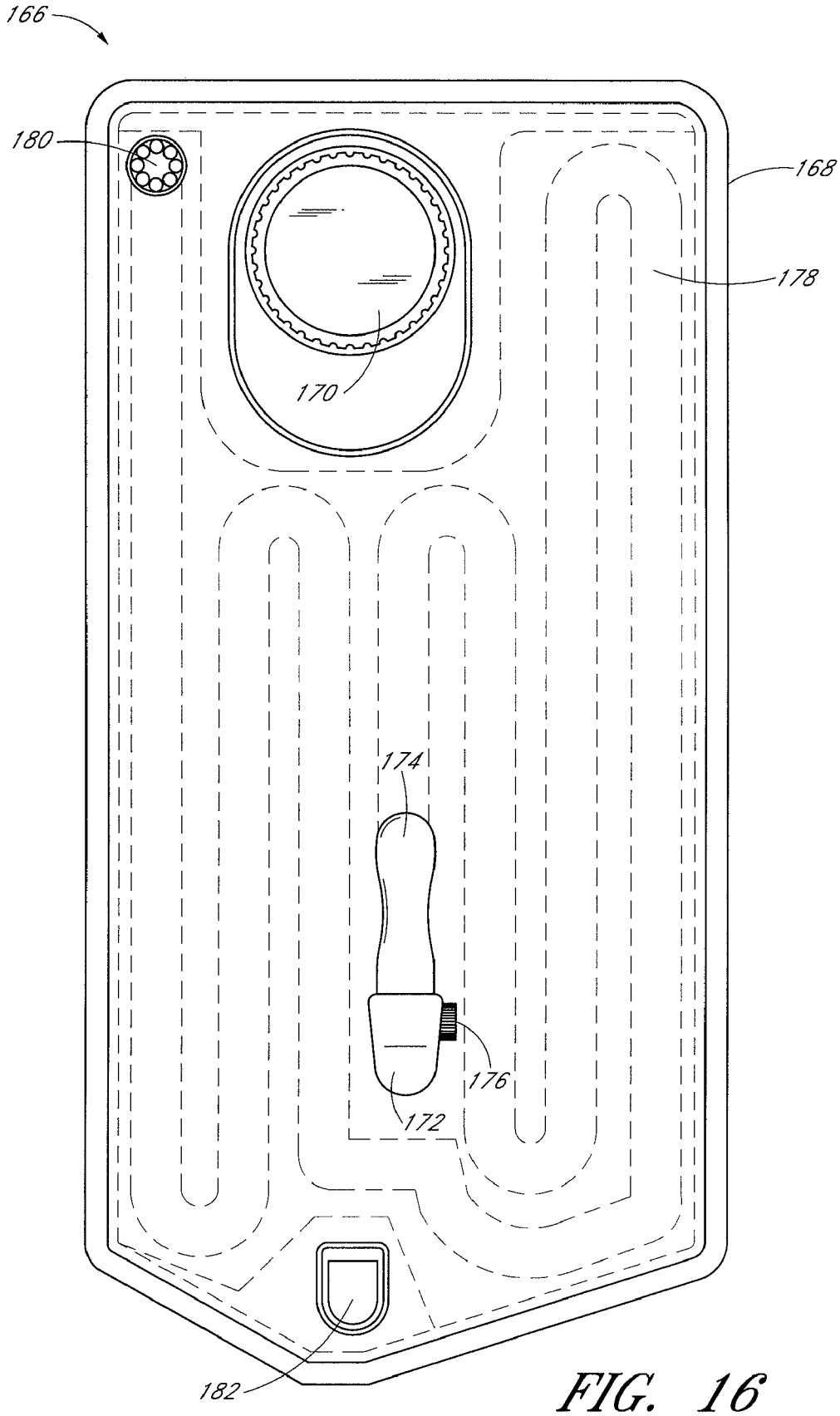

FIG. 16 illustrates a reservoir 166 configured for use of a pressurized gas to cool its contents and to pressurize an internal compartment. As illustrated, reservoir 166 includes bladder 168, fill port 170, pressure port 172, cartridge holder 174, regulator 176, transfer coil 178, and transfer port 180.

Bladder 168 defines an internal compartment for containing a liquid. Fill port 170 provides a sealable opening through which liquid can be introduced into bladder 168. Pressure port 172 represents an inlet through which a pressurizing gas can enter into transfer coil 178. Pressurizing gasses can be provided via a cartridge such as cartridge 48 seen in FIGS. 5 and 6. A cartridge holder 174 is configured to hold and cause the cartridge to mate with pressure port 172 in such a manner that pressurizing gas is allowed to exit the cartridge and enter transfer coil 178. Gases pass through transfer coil 178 and travel through transfer port 180 pressurizing the internal compartment of reservoir 166. Pressure regulator 176 functions to regulate the level at which the internal compartment is pressurized. Pressure regulator 176 may also function as a manual on/off switch and may regulate a rate at which pressurizing gas is allowed to escape a cartridge and enter the internal compartment.

Introduction of gas from a pressurized cartridge provides a cooling effect on the contents of bladder 168. The winding path of transfer coil 178 provides additional surface area allowing the escaping case to more effectively cool the contents of bladder 168. Transfer port 180 provides an internal connection between transfer coil 178 and the internal compartment holding the liquid.

Conclusion: The various examples discussed above allow for the pressurization of a hydration system where that pressurization functions to more efficiently expel liquid from a reservoir. Pressurization can be achieved through a variety of techniques including the use of pressurized gas cartridges and manual bulb type pumps. Where pressurized cartridges are used, the escaping gasses can be used to cool a reservoir's contents.

What is claimed is:

1. A hydration system, comprising:

opposing flexible walls forming a bladder having a sealable compartment for containing a liquid, a drinking tube having a first end with a valve and a second end;

a first port configured to receive pressurizing gasses into the compartment;

a baffle connecting the opposing walls within the compartment, the baffle configured to oppose expansion of the bladder as the pressurizing gasses are introduced into the compartment;

a second port configured to provide fluid communication between the compartment and the drinking tube;

a third port through which the liquid can be supplied into the compartment;

wherein, when sealed and pressurized, activation of the valve unseals the compartment and allows the liquid to be expelled from the compartment via the second port and the drinking tube as a result of a pressurization of the compartment by the pressurizing gasses; and a transfer coil having a first end coupled to the first port and a second end coupled to a fourth port, the fourth port defining an entry from the transfer coil into the compartment, the transfer coil having a surface positioned to be in at least indirect contact with the liquid in the compartment; and a cartridge holder configured to detachably couple to the first port, the cartridge holder configured to hold and to cause a cartridge to mate with the first port allowing pressurizing gasses to expel from the cartridge into the compartment via the transfer tube;

wherein pressurizing gasses when expelled from the cartridge have a cooling effect transferred to the liquid via the surface while pressurizing the compartment.

2. The hydration system of claim 1, wherein:

the first port is formed in one of the opposing walls and is configured to provide an ingress for the pressurizing gasses through that wall and into the compartment through that wall;

the second port is formed in one of the opposing walls and is configured to provide an egress for the liquid to pass from the compartment through that wall and into the drinking tube; and the third port is formed in one of the opposing walls and is configured to provide an ingress for the liquid through that wall and into the compartment.

3. The hydration system of claim 1, wherein the third port includes a cap configured to close the third port and wherein the first port is formed in the cap and is configured to provide an ingress for the pressurizing gasses through the cap into the compartment when the cap is closing the third port.

4. The hydration system of claim 3, wherein the first port and the second port are the same port.

5. The hydration system of claim 4, wherein:

the first port includes a first coupler;

the pressurizer includes a second coupler configured to detachably couple with the first coupler; and the second end of the drinking tube includes a third coupler configured to detachably couple with the first coupler.

6. The hydration system of claim 4, wherein:

the first end of the drinking tube includes a first coupler;

the valve includes a second coupler configured to detachably couple with the first coupler; and the pressurizer includes a third coupler configured to detachably couple with the first coupler.

7. The hydration system of claim 1, further comprising a pressurizer configured to detachably couple to the first port, the pressurizer operable to supply the pressurizing gasses for pressurizing the compartment when coupled to the first port.

8. The hydration system of claim 7, wherein the pressurizer includes a squeeze pump configured such that when manually squeezed, the squeeze pump expels pressurizing gasses into the compartment via the first port.

9. The hydration system of claim 7, wherein the pressurizer includes a cartridge holder configured to detachable couple to the first port, the cartridge holder configured to hold and to cause a cartridge to mate with the first port allowing pressurizing gasses to expel from the cartridge into the compartment via the first port.

10. The hydration system of claim 1, wherein:

the first port includes a first coupler;

the second port includes a second coupler;

the pressurizer includes a third coupler configured detachably couple with the first coupler; and the second end of the drinking tube includes a fourth coupler configured to detachably couple with the second coupler.

11. A hydration system, comprising:

a pack wearable by a user;

a bladder having a sealable compartment for holding a liquid, the compartment being formed by opposing flexible walls, a drinking tube having a first end with a valve and a second end;

a first port configured to receive pressurizing gasses into the compartment;

a baffle connecting the opposing walls within the compartment, the baffle configured to oppose expansion of the bladder as the pressurizing gasses are introduced into the compartment;

a second port formed in one of the opposing walls configured to couple to the second end of the drinking tube to provide fluid communication between the compartment and the drinking tube;

a third port formed in one of the opposing walls through which the liquid can be supplied into the compartment;

a pressurizer configured to detachably couple to the first port, the pressurizer operable to supply the pressurizing gasses for pressurizing the compartment when coupled to the first port, the pressurizer being integrated into the pack;

a transfer coil having a first end coupled to the first port and a second end coupled to a fourth port, the fourth port defining an entry from the transfer coil into the compartment, the transfer coil having a surface positioned to be in at least indirect contact the liquid in the compartment; and a cartridge holder configured to detachably couple to the first port, the cartridge holder configured to hold and to cause a cartridge to mate with the first port allowing pressurizing gasses to expel from the cartridge into the compartment via the transfer tube;

wherein, when sealed and pressurized, activation of the valve unseals the compartment and allows the liquid to be expelled from the compartment via the second port and the drinking tube as a result of a pressurization of the compartment by the pressurizing gasses; and wherein pressurizing gasses when expelled from the cartridge have a cooling effect transferred to the liquid via the surface while pressurizing the compartment.

12. The hydration system of claim 11, wherein the pressurizer includes a squeeze pump configured such that when manually squeezed, the squeeze pump expels pressurizing gasses into the compartment via the first port.

13. The hydration system of claim 12, wherein:

the pack includes a shoulder strap; and the squeeze pump is integrated into the shoulder strap.

14. The hydration system of claim 11, wherein the pressurizer includes a cartridge holder configured to detachable couple to the first port, the cartridge holder configured to hold and to cause a cartridge to mate with the first port allowing pressurizing gasses to expel from the cartridge into the compartment via the first port.

15. The hydration system of claim 11, wherein the first port and the second port are the same port.

16. The hydration system of claim 15, wherein:

the first port includes a first coupler;

the pressurizer includes a second coupler configured to detachably couple with the first coupler; and the second end of the drinking tube includes a third coupler configured to detachably couple with the first coupler.

17. The hydration system of claim 15, wherein:

the first end of the drinking tube includes a first coupler;

the valve includes a second coupler configured to detachably couple with the first coupler; and the pressurizer includes a third coupler configured to detachably couple with the first coupler.

18. The hydration system of claim 11, wherein:

the first port includes a first coupler;

the second port includes a second coupler;

the pressurizer includes a third coupler configured detachably couple with the first coupler; and the second end of the drinking tube includes a fourth coupler configured to detachably couple with the second coupler.

* * * * *